US005732775A

United States Patent [19]

Hudson et al.

[11] Patent Number: 5,732,775

[45] Date of Patent: Mar. 31, 1998

[54] MULTIPLE CASING SEGMENT CEMENTING SYSTEM

[75] Inventors: Leo D. Hudson; Richard M. Dobson, both of Bakersfield; Jefferey D. Herndon, California, all of Calif.

[73] Assignee: Bestline Liner Systems, Inc., Bakersfield, Calif.

[21] Appl. No.: 699,997

[22] Filed: Aug. 20, 1996

[51] Int. Cl.[6] ..... E21B 33/13

[52] U.S. Cl. ..... 166/177.4; 166/289; 166/290; 166/318

[58] Field of Search ..... 166/154, 177.4, 166/285, 289, 290, 291, 313, 318

[56] References Cited

U.S. PATENT DOCUMENTS

| | | | |
|---|---|---|---|
| 2,659,438 | 11/1953 | Schnitter | 166/154 |
| 3,381,756 | 5/1968 | Reagan | 166/289 X |
| 3,791,448 | 2/1974 | Schuh | 166/291 |
| 4,450,912 | 5/1984 | Callihan et al. | 166/289 |
| 4,469,174 | 9/1984 | Freeman | 166/318 X |
| 5,277,255 | 1/1994 | Bell | 166/290 |
| 5,425,423 | 6/1995 | Dobson et al. | 166/318 X |

*Primary Examiner*—George A. Suchfield
*Attorney, Agent, or Firm*—Lyon & Lyon LLP

[57] ABSTRACT

A system including method and apparatus for placing and cementing a plurality of scab liners as well as a surface liner in a well with one placement. A duplex assembly is created using a lower duplex tool having a duplex shoe with a valve assembly positioned in the duplex tool. A scab casing is fixed to the duplex tool and drill pipe extends into the scab casing to mate with the valve assembly. A ratchet insures locking of the drill string. The valve assembly includes elements to control flow of cement to outwardly of the scab casing and the flow of flushing fluid inwardly of the scab casing. A locking mechanism using floating dogs controlled by a locking sleeve allows unlocking of the valve assembly from the duplex tool upon completion of the cementing and flushing operation. Similar operations are conducted in succeeding duplex assemblies upwardly along the string, each succeeding scab casing being cemented in turn. Once the cementing is complete, the string and valve assemblies are withdrawn from the well leaving liner segments cemented in place with drill-out duplex elements remaining.

22 Claims, 11 Drawing Sheets

MULTIPLE CASING SEGMENT CEMENTING SYSTEM

BACKGROUND OF THE INVENTION

The field of the present invention is apparatus and technique for installing casing in a well.

In oil well drilling operations, a plurality of tasks must be performed in completing a well beyond drilling the well bore. Well casing extending upwardly from the production zone is to be positioned and cemented. Where multiple production zones overlay one another, scab casings between each production zone are frequently cemented into place. Once the casing has been installed, slotted liners may be positioned in the production zones, frequently with gravel packing, cementing and sealing of such liners to the casing. Underreaming of the production zone areas may precede placement of the liners. Finally, appropriate mechanisms are placed in the hole for production.

Economical completion of a well is of great interest. One means to reduce the cost of well completion is to limit the number of trips required down the well. Each trip involves the placement and/or removal of tools and equipment. A pipe string thousands of feet long must be assembled and disassembled in the process of inserting tools and equipment. Consequently, it is advantageous to complete as many functions as possible with a single trip into the well bore.

Duplex cementing systems have been available for cementing sections of a well. Such systems are available for either liners or casings. The duplex tool is associated with either a guide shoe or a cementing basket depending on the position in the well. Duplex tools are most appropriately of aluminum to allow the blockage created by the tool to be drilled out for later placement of liners or equipment. The tool includes a port or ports for delivering a charge of cement to outwardly of a casing or liner to which the tool is fixed. These cementing ports can then be closed or blocked and other ports opened to establish circulation down the drill pipe, out the duplex tool and up the interior of the liner or casing. The valve portion of the equipment is then unthreaded from the aluminum shoe or collar and removed. The system has required one trip down the well for each section placed.

In the installation of liners in a well, multiple functions with a single trip into the well are known. Schemes for gravel packing wells and the like with a single placement of drilling tools has been used. Reference is made to U.S. Pat. Nos. 5,253,708 for PROCESS AND APPARATUS FOR PERFORMING GRAVEL-PACKED LINER COMPLETIONS IN UNCONSOLIDATED FORMATIONS; 5,255,741 for PROCESS AND APPARATUS FOR COMPLETING A WELL IN AN UNCONSOLIDATED FORMATION; 5,425,423 for WELL COMPLETION TOOL AND PROCESS; and 5,497,840 for WELL TOOL AND PROCESS OF COMPLETING A WELL, the disclosures of which are incorporated herein by reference.

SUMMARY OF THE INVENTION

The present invention is directed to the placement and cementing of casings accomplished with a single placement of equipment in the well.

In a first, separate aspect of the present invention, a valve assembly is configured to extend into the cavity of a duplex tool. An engagement pipe includes a threaded pin for association with one end of the valve assembly. A ratchet assembly is associated with the engagement pipe and the valve assembly to control the engagement between the two. In further association with this aspect, the ratchet may be spring biased from a position on the engagement pipe with stops provided on the valve assembly. The ratchet may also be cylindrical in configuration. The duplex tool may include a duplex shoe or a cementing basket.

In a second, separate aspect of the present invention, a duplex assembly includes a duplex tool with a valve assembly extendable into the cavity of the duplex tool. A lock assembly on the valve assembly provides selective engagement with the duplex tool for extraction without unthreading components. This aspect may further include association of a scab casing with the duplex tool. The duplex tool may again include a shoe or a cementing basket.

In a third, separate aspect of the present invention, a duplex assembly includes a duplex tool and a valve assembly extending into the cavity of the duplex tool. The duplex assembly provides a through passage. Valving systems provide for closure of the passage and direction of the flow outwardly of the associated casing for cementing and inwardly of the casing for flushing of the annulus.

The foregoing aspects may also be considered in combination with one another to form yet further, separate aspects of the invention. Additionally, multiples of the features of the foregoing aspects may be associated. Such association provides for the placement of multiple separate sections of casing in a well with a single insertion of equipment.

In a further, separate aspect of the present invention, the steps of positioning multiple liner segments in a well with subsequent cementing of the segments and flushing of the interiors are accomplished in sequential order. Release of the casing segments may be further applied to this aspect of the present invention.

Accordingly, it is an object of the present invention to provide improved systems for the placement of casing segments within a well. Other and further objects and advantages will appear hereinafter.

DETAILED DESCRIPTION OF THE PREFERRED EMBODIMENT

Figure 1:
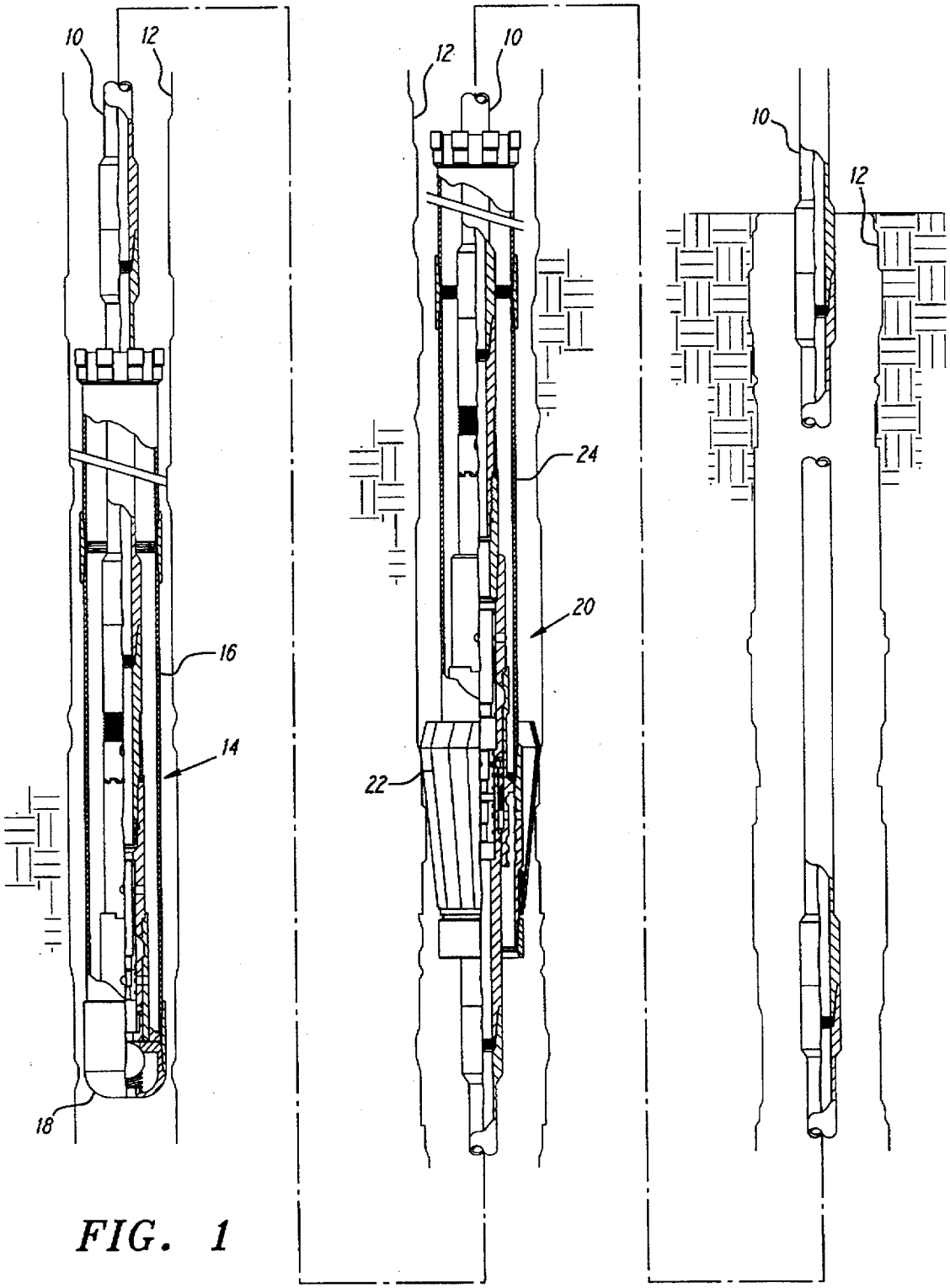
FIG. 1 is a string assembly employing multiple duplex assemblies.
Figure 2:
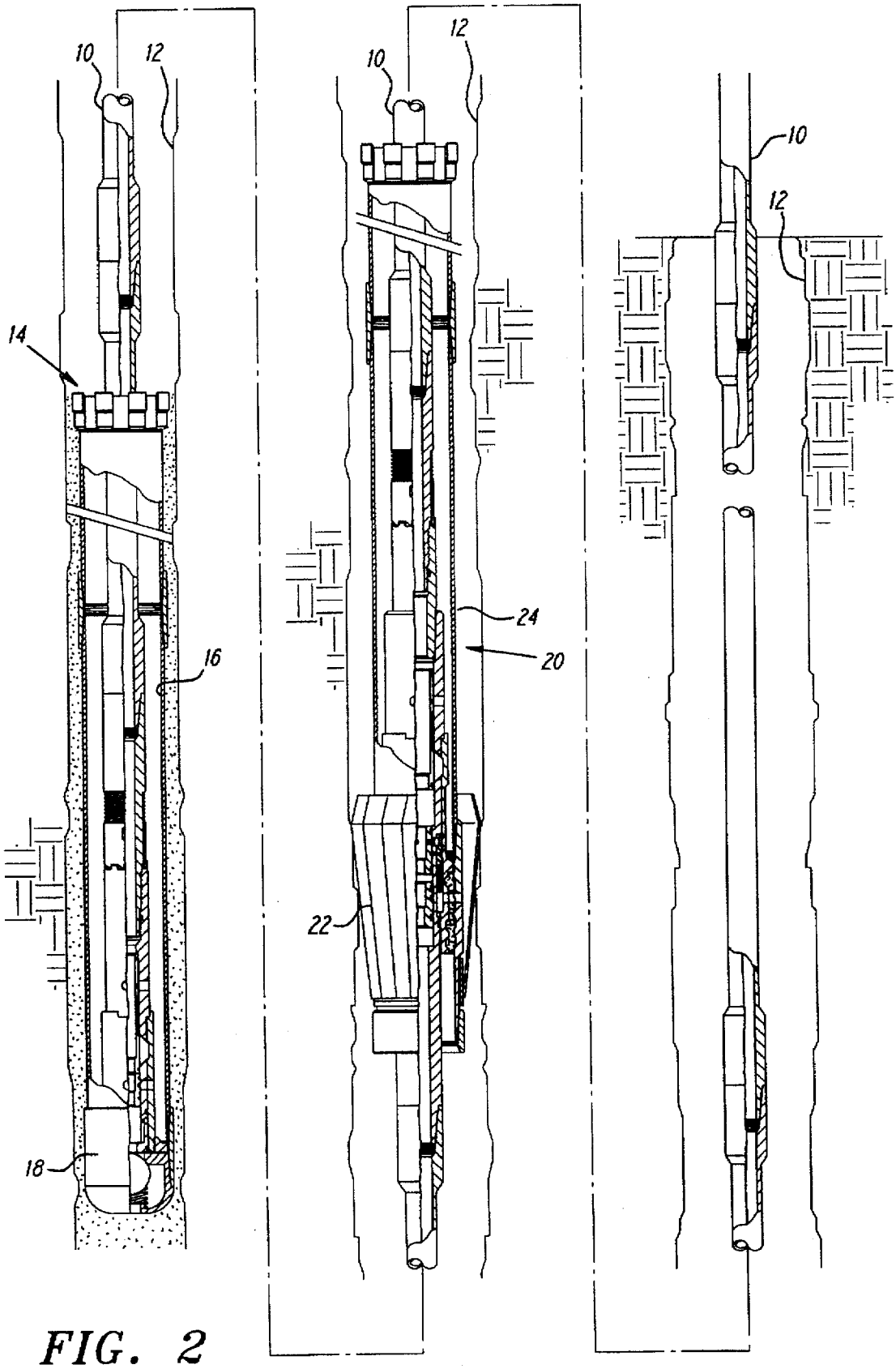
FIG. 2 is the string assembly of FIG. 1 with the bottom scab casing cemented.
Figure 3:
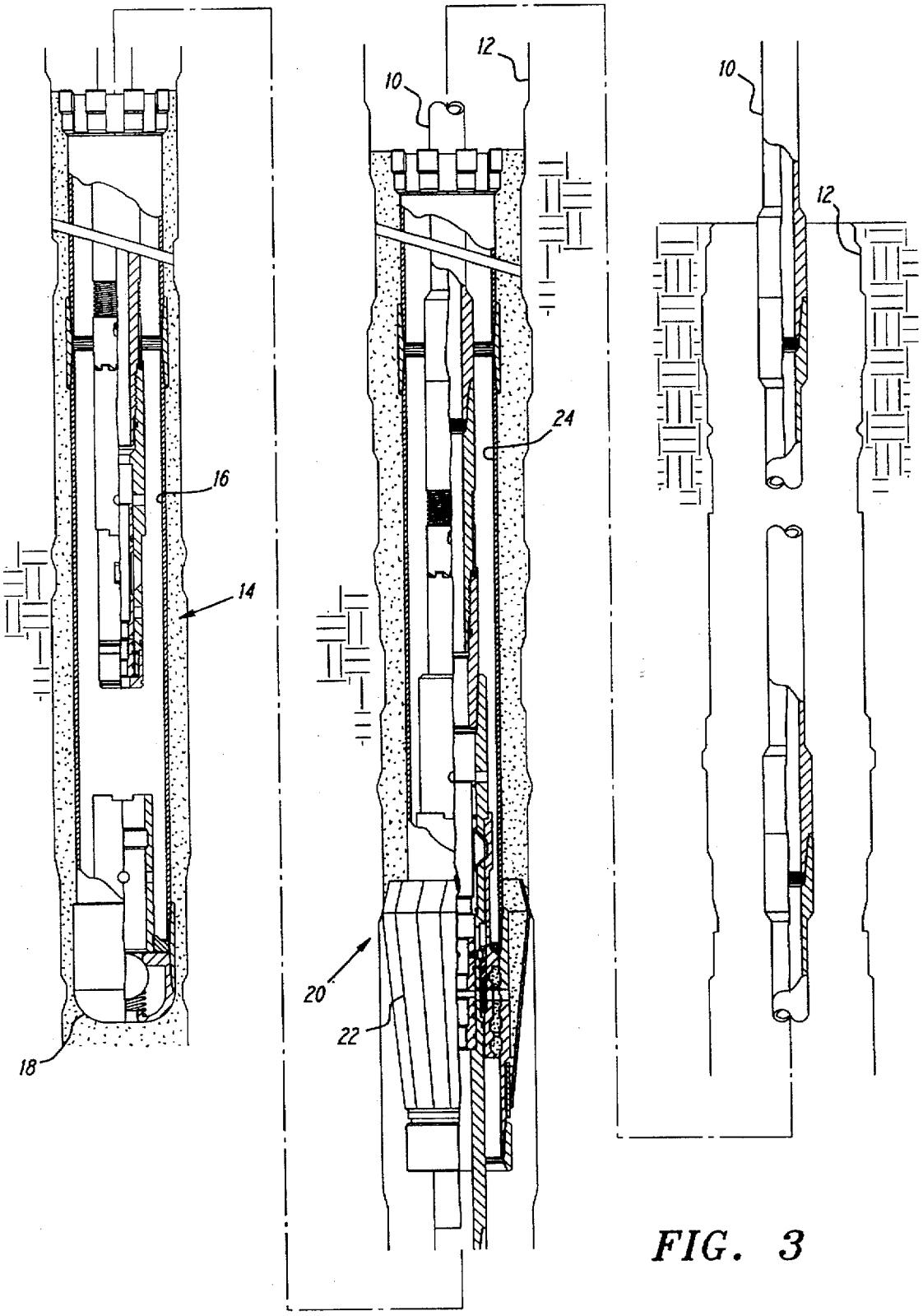
FIG. 3 is the string assembly of FIG. 1 with the bottom scab casing and an upper scab casing cemented.
Figure 4:
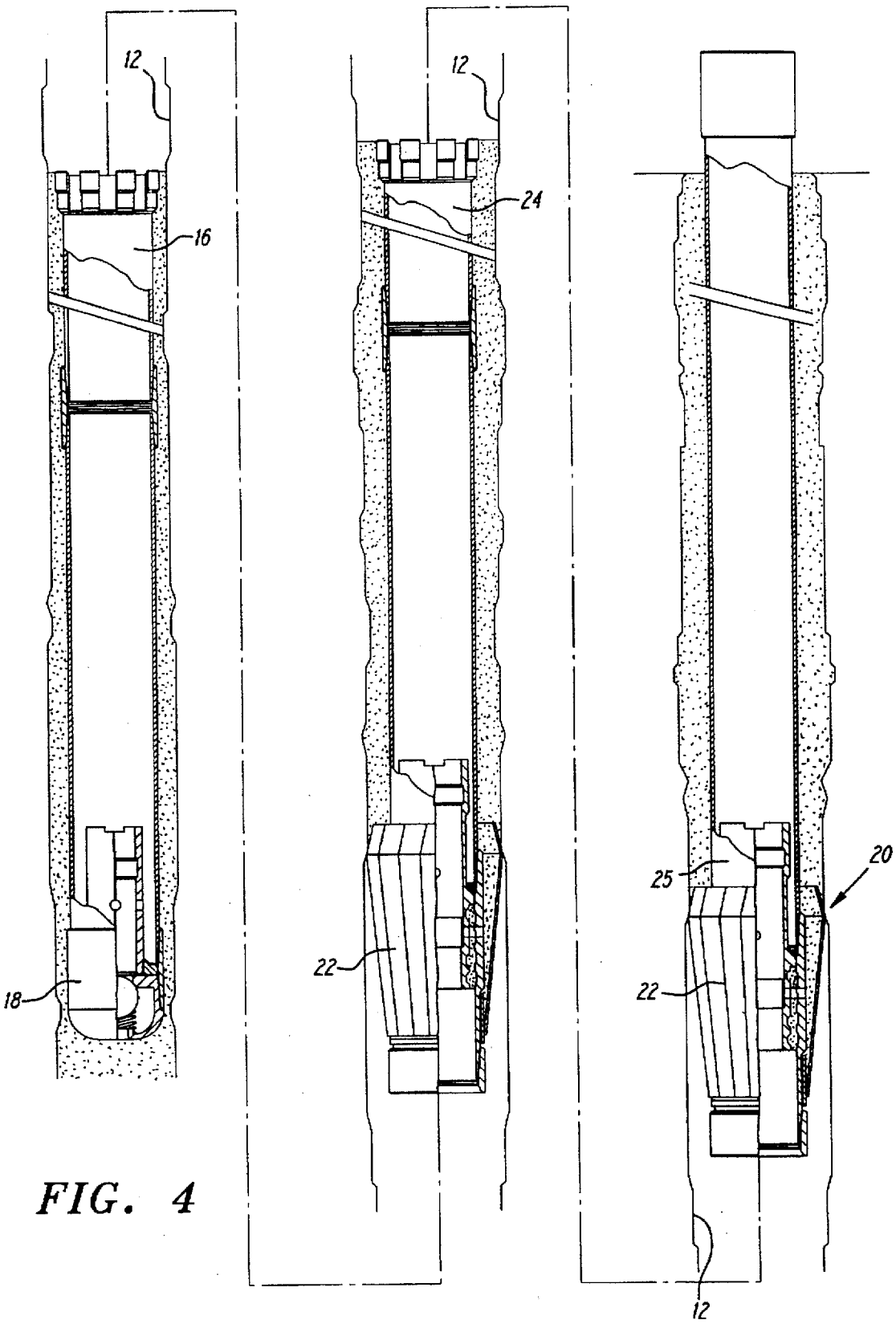
FIG. 4 is another string assembly similar to FIG. 1 but including a duplex system for cementing the surface casing with all casings cemented.

Turning in detail to the drawings, FIG. 1 illustrates a compound duplex assembly generally presenting the layout of one of the preferred embodiments. Drill pipe 10 is shown extending into a well bore 12. A lower duplex assembly, generally designated 14, is shown with attachment to the end of the pipe string. The assembly 14 includes a scab liner 16. This lower duplex assembly 14 is fitted with a duplex shoe 18. An upper duplex assembly, generally designated 20, includes attachments to drill pipe 10 both top and bottom. The upper duplex assembly 20 is fitted with a cementing basket 22. Multiple upper duplex assemblies 20 may be included within the duplex assembly. Each upper duplex assembly 20 is also fitted with a scab liner 24. FIG. 1 illustrates the compound duplex assembly as it is positioned within the hole. FIGS. 2, 3 and 4 illustrate progressive cementing steps as the cementing operation moves upwardly in the well bore 12. FIG. 4 additionally illustrates an upper duplex assembly 20 used with a surface casing 25. The system may be employed for all casings within a well as may be required.

Figure 5:
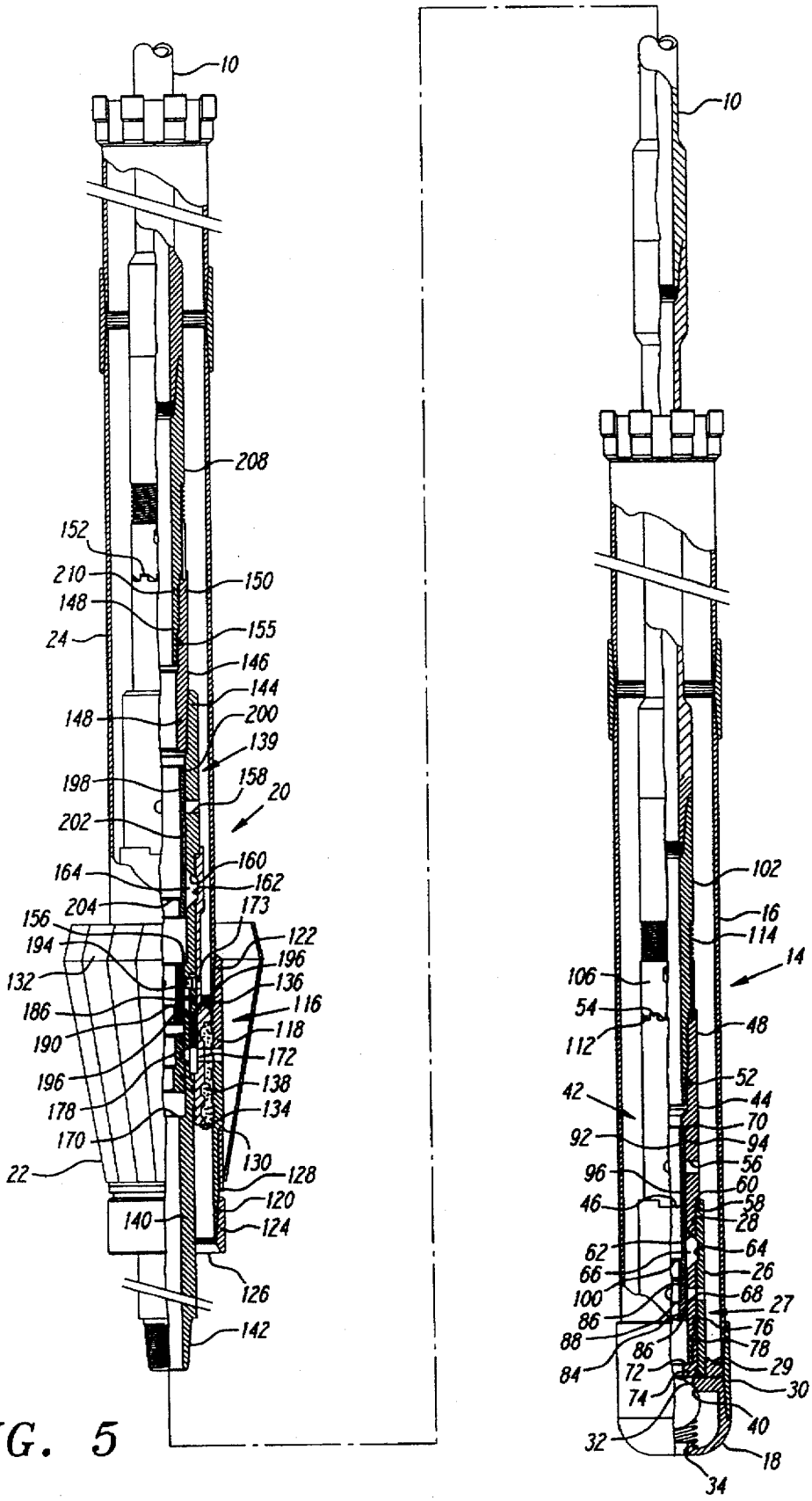
FIG. 5 is a compound assembly of duplex tools shown in partial cross section.

Looking to the details of the lower duplex assembly 14 seen in FIG. 5, a cylindrical housing 26 provides a central core of the lower duplex tool, generally designated 27, and defines a central cavity 28 extending axially of the lower duplex assembly The housing 26 is externally threaded and locked with an annular ring 29. A threaded collar 30 is in turn positioned about the outside of the annular ring 29. The duplex shoe 18 is associated with the lower side of the threaded collar 30 while the scab casing 16 extends upwardly as seen in FIGS. 1 through 4, also from the threaded collar 30.

The duplex shoe 18 has a passage centrally therethrough aligned with the central cavity 28 and defined in part by an upper port 32 and a lower port 34. A ball check valve is within the passage. The ball check valve includes a ball 36 and a spring 38 biasing the ball 36 against a seat 40 at the upper port 32. Thus, the check valve only allows passage of fluid through the duplex shoe 18 in a downward direction against the operation of the spring 38. The duplex tool 27 is preferably made of a material which can be easily drilled out during subsequent operations. Aluminum is commonly employed for the several components with the exception of the threaded collar 30 and the scab casing 16 which are not to be drilled out.

A valve assembly, generally designated 42, extends into the central cavity 28 of the lower duplex tool 27. The valve assembly 42 includes a substantially cylindrical body 44 having a passage 46 therethrough. The passage 46 of the cylindrical body 44 is threaded through a portion of its upper length, defining an internally threaded end 48. This end 48 faces upwardly away from the duplex tool 27. Below the threads in the internally threaded end 48 is an annular cavity 50, best seen in FIGS. 6*a* through 6*c*. The cavity receives a seal 52, shown in FIG. 5 to be a lip seal. Stops 54 are defined by recesses cut partially into the body 44 about the outside of the upper rim of the internally threaded end 48, as best illustrated in FIG. 5.

Below the internally threaded end 48, the cylindrical body 44 includes radial ports 56 extending through the wall and spaced about the periphery. The radial ports 56 are shown to be above the cylindrical housing 26 as seen in the preferred embodiment. Below the radial ports 56, a shoulder 58 is found on the outside of the body 44. The shoulder 58 extends to a seat 60 on the upper end of the cylindrical housing 26.

The shoulder 58 and seat 60 may each lie in a plane or may include interlocking tab portions so as to axially align the body 44 with the housing 26.

Tapered slots 62 extend radially through the wall of the body 44 at four equiangular positions below the shoulder 58. The cylindrical housing 26 includes corresponding recesses 64 in the wall of the housing 26 from the cylindrical cavity 28. Floating dogs 66 are arranged in the tapered slots 62 and corresponding recesses 64. The dogs 66 are also tapered so as to fit closely within the cavities thus formed.

A further set of radial ports 68 is arranged below the tapered slots 62 in the body 44 and also extends through the housing 26. These radial ports 68 and the radial ports 56 are spaced about and through the wall of the body 44 so that fluid flow may easily exit through these ports when open.

Internally of the body 44, a uniform bore is provided between an upper shoulder 70 and a lower shoulder 72. The lower shoulder 72 is defined by an inwardly extending flange 74 on an end piece 76 which is threaded to the main body portion of the cylindrical body 44. A set screw 78 retains the end piece 76 on the lower end of the cylindrical body 44. The uniform bore between the shoulders 70 and 72 on the inner surface of the body 44 provides for the placement and sliding of sleeve elements therein. On the outer surface of the cylindrical body 44 fitting within the cavity 27 of the cylindrical housing 26, a lip seal 80 and an O-ring 82 prevent flow between the components.

Figure 6A:
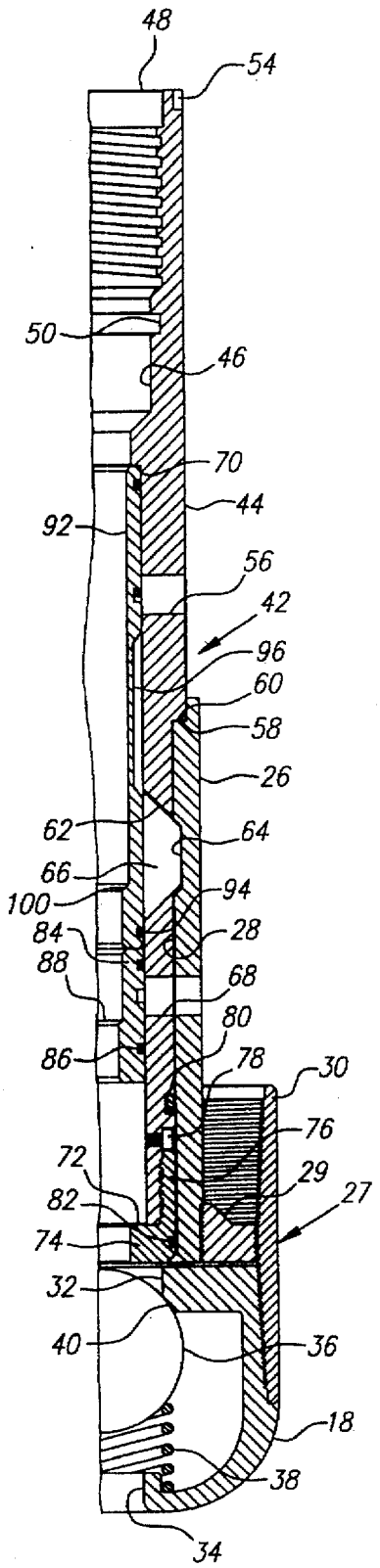
FIG. 6*a* is a cross section of a duplex assembly.
Figure 6B:
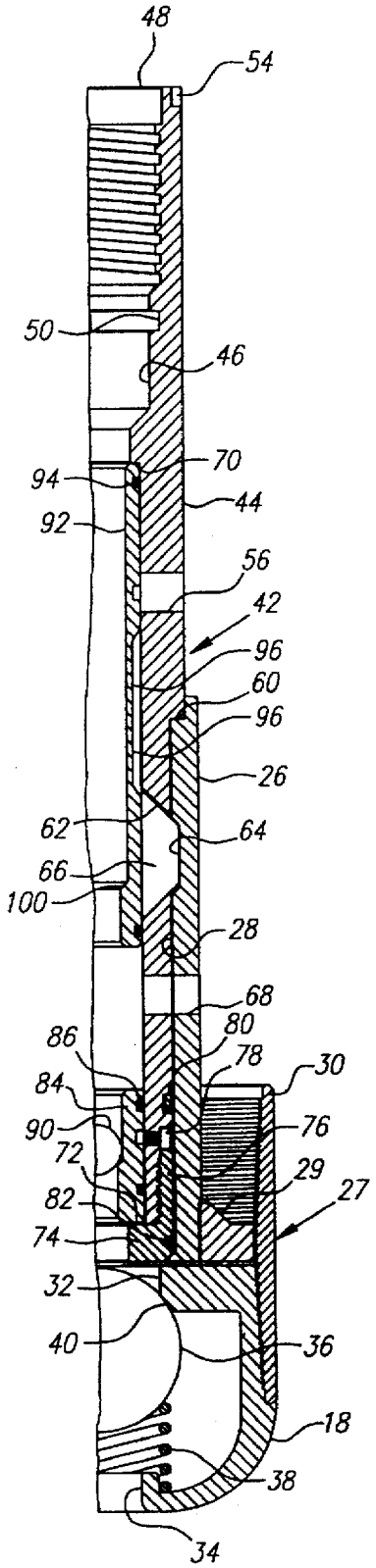
FIG. 6*b* is a cross section of the duplex assembly of FIG. 6*a* with a valve sleeve in the open position.

The duplex assembly 14 further includes a valve sleeve 84 as part of the valve assembly 42. The valve sleeve 84 closely slides within the uniform bore of the cylindrical body 44. O-rings 86 prevent flow between the valve sleeve 84 and the uniform bore of the cylindrical body 44. The valve sleeve 84 is originally positioned to cover the radial port 68. In that position, shear pins are placed to extend from the body 44 to the valve sleeve 84. A tapered shoulder 88 on the inner surface of the valve sleeve 84 provides a seat for a ball 90. When the ball 90 is positioned in the valve sleeve 84, the shear pins fail and the valve sleeve 84 assumes a second position displaced from the radial ports 68 and against the lower shoulder 72. The two positions of the valve sleeve 84 are illustrated in FIGS. 6*a* and 6*b*. Circulation is terminated through the end of the duplex tool 27 with the ball 90 in place. Access from the central passage to outwardly of the scab casing 16 is, therefore, cut off. Instead, the central passage is in communication through the ports 68 with the annulus, inwardly of the casing.

Figure 6C:
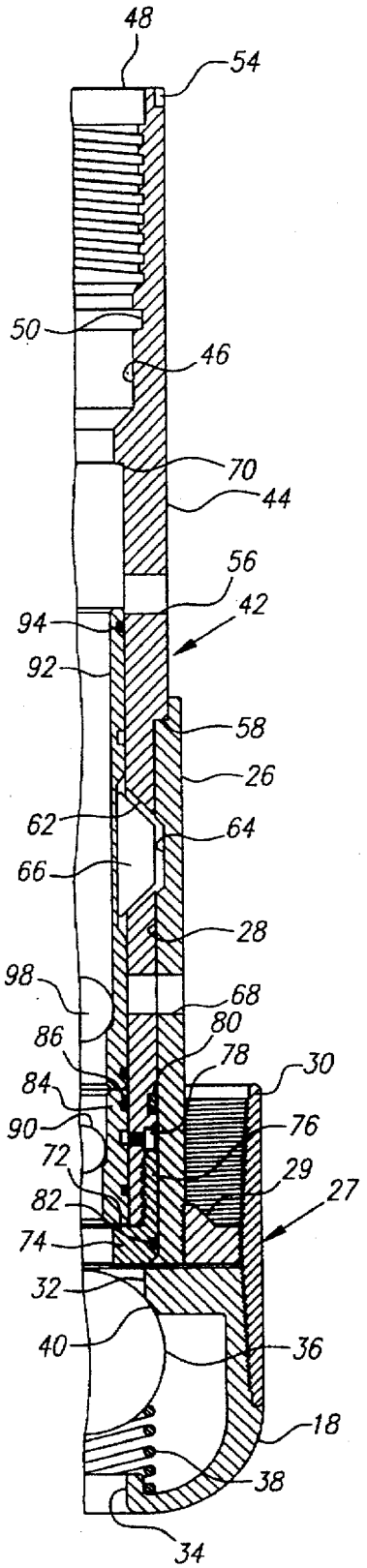
FIG. 6*c* is a cross section of the duplex assembly of FIGS. 6*a* and 6*b* with the locking sleeve in an unlocking position.
Figure 7A:
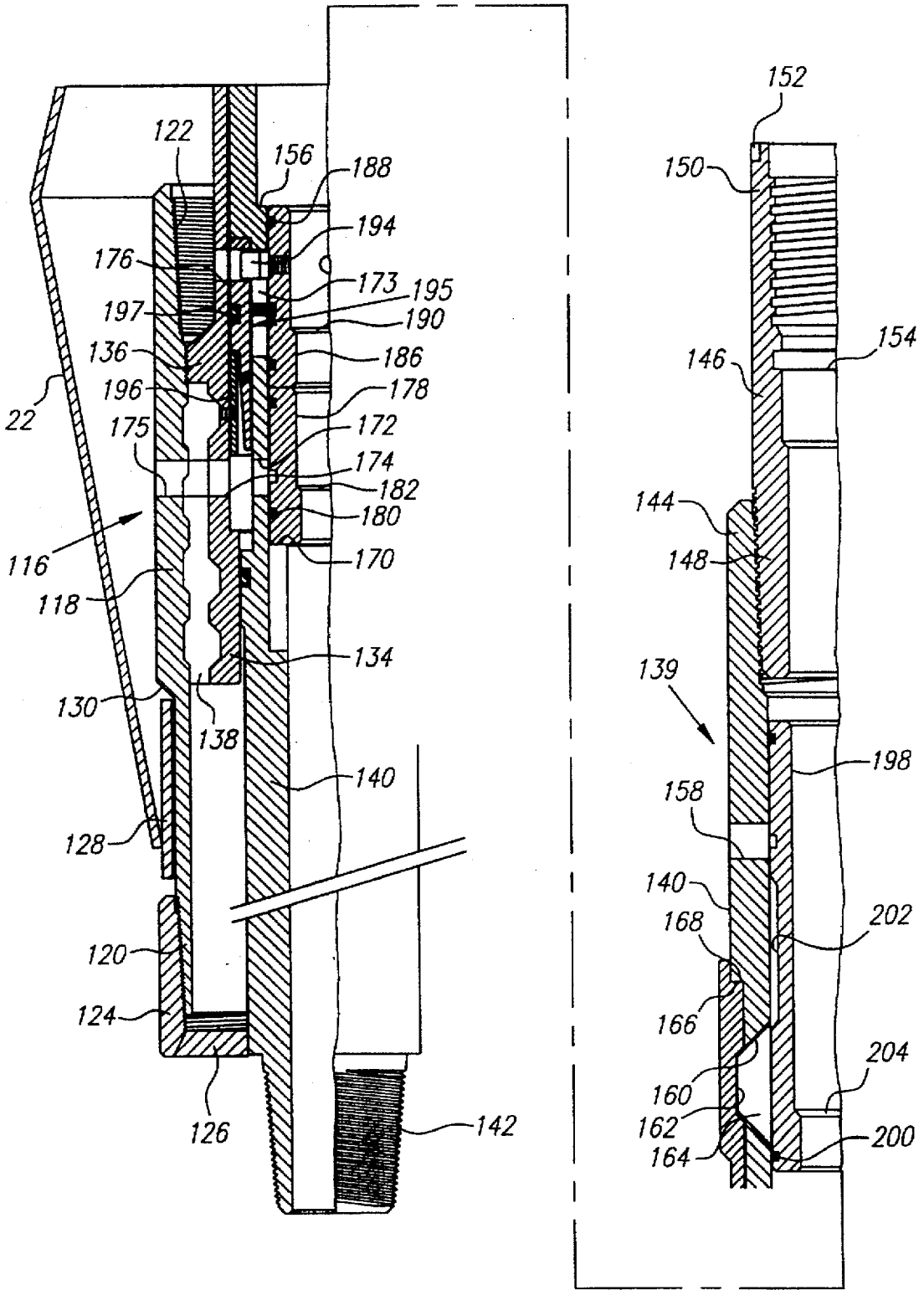
FIG. 7*a* is a cross section of a duplex assembly.
Figure 7B:
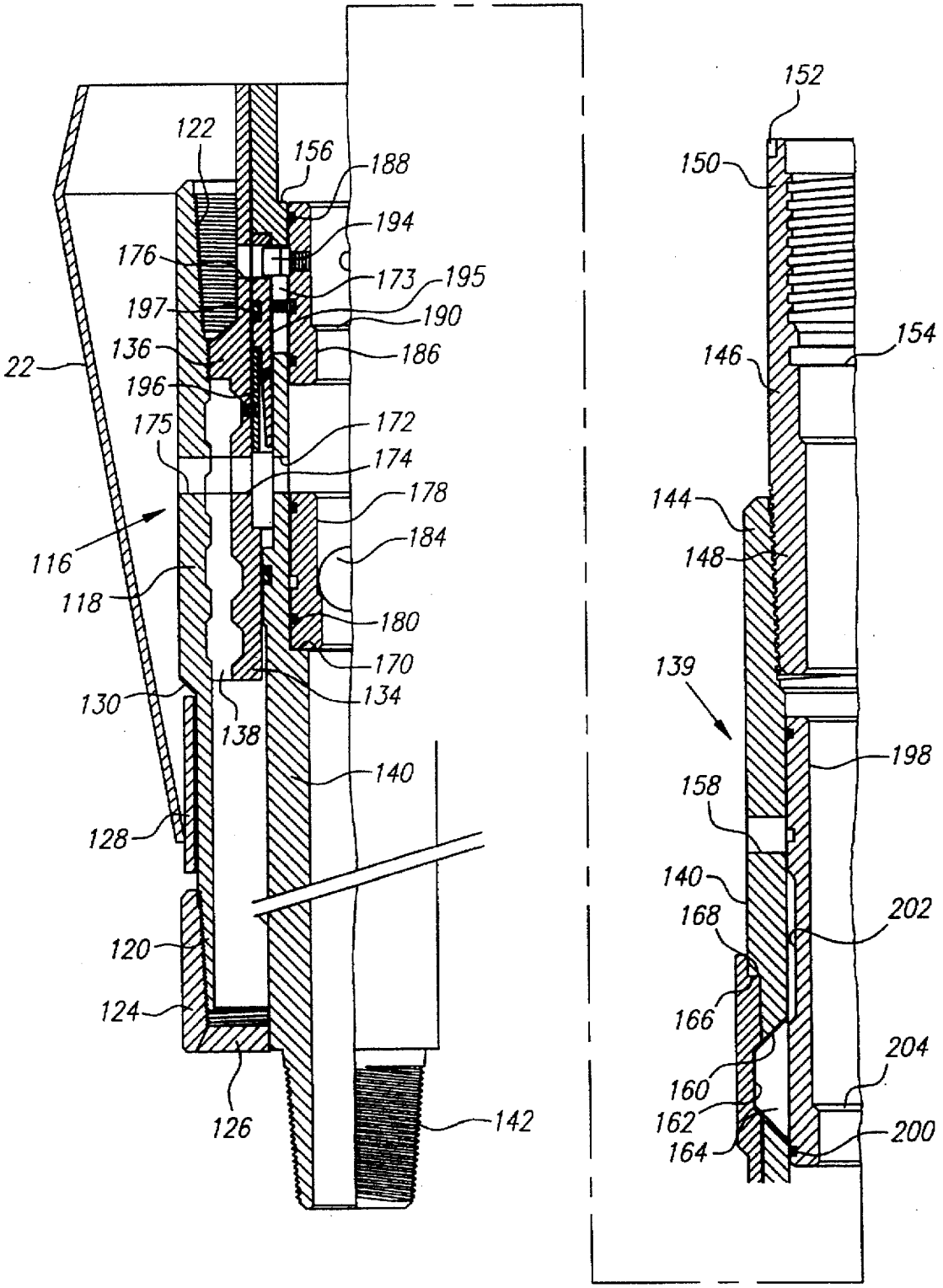
FIG. 7*b* is a cross section of the duplex assembly of FIG. 7*a* with a valve sleeve in the actuated position.
Figure 7C:
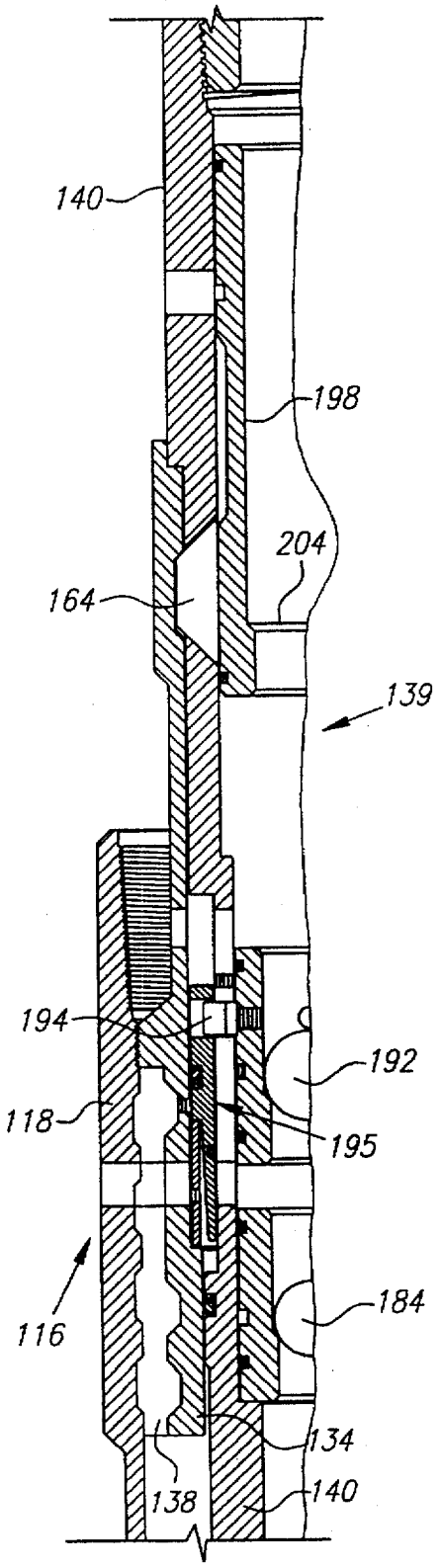
FIG. 7*c* is a cross section of the duplex assembly of FIG. 7*a* with a second valve sleeve in the actuated position.
Figure 7D:
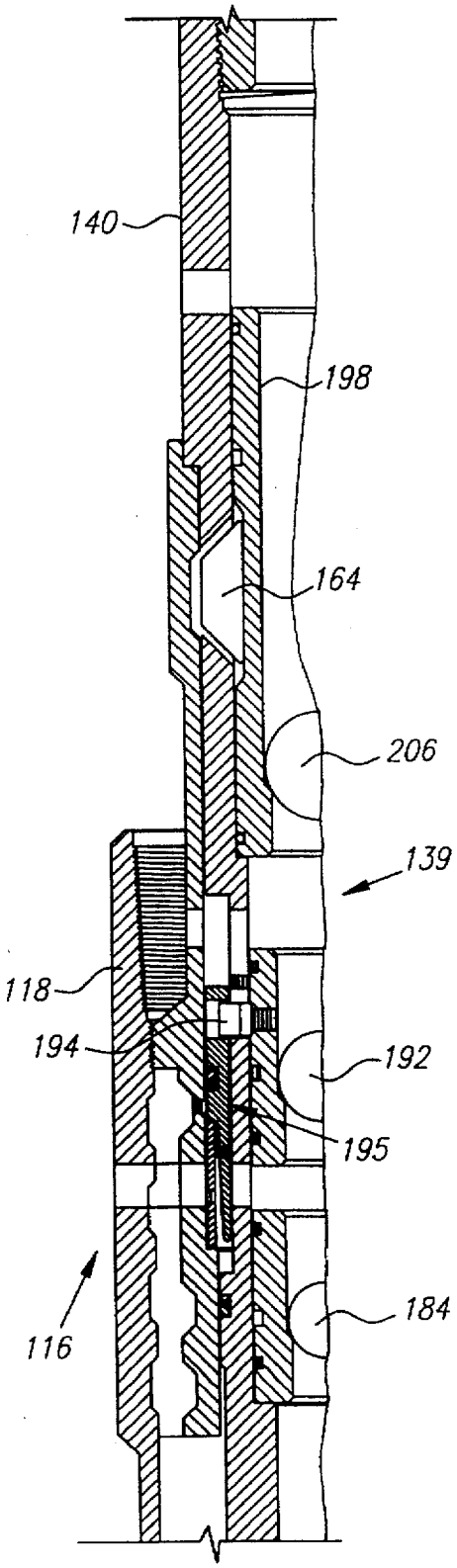
FIG. 7*d* is a cross section of the duplex assembly of FIG. 7*a* with a locking sleeve in an unlocking position.

Positioned within the uniform bore of the body 44 is a locking sleeve 92. The locking sleeve 92 in cooperation with the dogs 66 define a lock assembly. The locking sleeve 92 includes O-rings 94 to prevent fluid flow between the sleeve 92 and the body 44. The sleeve 92 has an annular recess 96 through a portion of its axial length. Shear pins retain the locking sleeve 92 in its upper, initial position which is seen in FIGS. 6*a* and 6*b*. In this position, the radial ports 56 are covered and the floating dogs 66 are forced outwardly to extend through the tapered slots 62 into the corresponding recesses 64 in the cylindrical housing 26. Thus, the upper position of the locking sleeve 92 provides a locking between the duplex tool 27 and the valve assembly 42. The locking sleeve 92 is illustrated in the lower position in FIG. 6*c*. In that position, the recess 96 extends over the floating dogs 66, releasing them from the recesses 64 in the cylindrical housing 26. Additionally, the radial ports 56 are open. A second ball 98 cooperating with a tapered shoulder 100 on the inside of the locking sleeve 92 shears the locating pins and drives the locking sleeve 92 to its lower, final position as seen in FIG. 6*c*.

Figure 8:
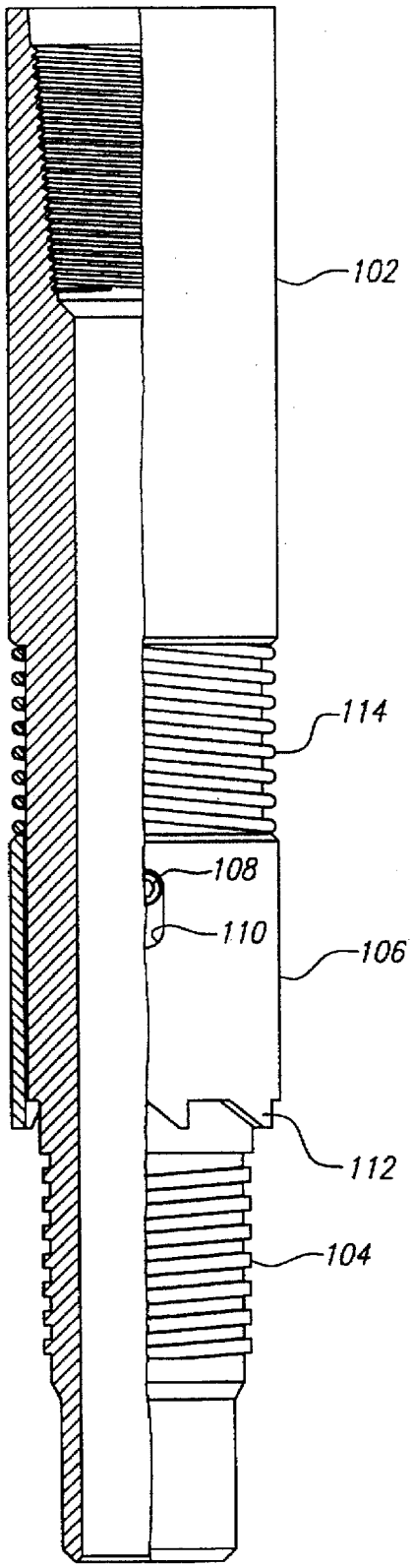
FIG. 8 is a partial cross-sectional view of an engagement pipe with a ratchet.

An engagement pipe 102 includes a threaded pin 104 at one end thereof as seen in FIG. 8. The threaded pin threadably engages the internally threaded end 48 of the cylindrical body 44 of the valve assembly. FIG. 8 illustrates the engagement pipe 102 while FIG. 5 shows the association between the engagement pipe 102 and the cylindrical body 44. A cylindrical ratchet 106 is arranged about the engagement pipe 102 adjacent to the threaded pin 104. The ratchet 106 is maintained in place by a pin 108 riding within a slot 110 on the cylindrical ratchet 106. The ratchet 106 includes teeth 112 at one end thereof. A spring 114 biases the cylindrical ratchet 106 toward the threaded pin 104.

With the engagement pipe 102 threaded into the internally threaded end 48, the teeth 112 of the ratchet 106 engage the stops 54 on the cylindrical body 44. Once engaged, the engagement pipe 102 cannot be disengaged from the cylindrical body 44 without axially displacing the ratchet 106 against the force of the spring 114. The engagement pipe 102 may be fixed to the valve assembly 42 without necessarily requiring the application of high torque to the connection to insure retention. The valve assembly is in turn locked to the duplex tool 27 by the lock assembly in order that the entire lower duplex assembly 14 may be suspended by the engagement pipe 102. Drill pipe 10 is in turn coupled with the engagement pipe 102 to support the lower duplex assembly 14.

The upper duplex assembly 20 is illustrated in association with the lower duplex assembly 14 in FIG. 5. Additionally, details of this device are presented in FIGS. *7a* through *7d*. The upper duplex assembly 20 has similar mechanisms to that of the lower duplex assembly 14. A cavity extends through a duplex housing, generally designated 116. In this case, the housing 116 is made of a first substantially cylindrical element 118 having a threaded pin 120 at one end and an integral internally threaded collar 122 at the other. The threaded pin 120 receives a collar 124 having a beveled lower entry 126 into the interior of the housing 116. The integral collar 122 receives the end of a scab casing 24 as seen in FIG. 1 which extends upwardly beyond this upper duplex assembly 20.

Associated with the outer element 118 is a cementing basket 22 only illustrated in FIGS. *7a* and *7b*. The cementing basket 22 includes a collar 128 held between a shoulder 130 and the lower collar 124. The cementing basket 22 further includes overlapping leaves 132 extending outwardly and upwardly from the collar as seen in FIG. 5. The leaves are able to open outwardly against the well bore and yet provide a solid barrier against cement flowing downwardly through the basket.

The housing 116 also includes an inner, annular element 134. This element includes an annular boss 136 having threads thereabout to engage mating threads on the inner side of the element 118. A gap is found between the elements 118 and 134 adjacent to the annular boss 136. This gap is .filled with cement 138. The annular element 134 extends upwardly from the annular boss 136 to form the substantially cylindrical body.

A valve assembly, generally designated 139, is positioned in the cavity of the inner, annular element 134. This valve assembly 139 includes a substantially cylindrical body 140. The body extends from a threaded pin 142 to an internally threaded end 144. An adapter element 146 includes a pin 148 to threadably attach to the end 144. It also includes an internally threaded upper end 150 having stops 152 about the outer periphery in the same configuration as the stops 54 associated with the cylindrical body 44. An annular cavity 154 is arranged to receive a lip seal 155 for sealing between the components.

The body 140 includes a first substantially uniform bore extending between the bottom of the pin 148 and an inwardly extending shoulder 156. Within that uniform bore, radial ports 158 extend through the wall of the body 140.

As provided in the lower duplex assembly 14, a lock assembly is associated with the valve assembly and extends to engage the housing 116. Tapered slots 160 extend through the wall of the body 140 into corresponding recesses 162. Floating dogs 164 are arranged in the tapered slots 160, extending outwardly into the corresponding recesses 162. Also, as with the lower duplex assembly 14, an annular shoulder 166 in the body 140 rests within a seat 168 in the housing 116.

Below the upper uniform bore extending down to the shoulder 156, a second uniform bore is provided to an inwardly extending annular shoulder 170 cut within the inside of the body 140. Two further sets of radial ports 172 and 173 extend through the wall of the body 140 in the lower uniform bore. Aligned ports 174 and 175 extend through the inner element 134 and the outer element 118, respectively, of the housing 116. Passage is also provided through the cement 138, all aligned with the ports 172. Ports 176 aligned with the ports 173 extend through the inner element 134.

A valve sleeve 178 is arranged within the lower uniform bore within the body 140. This valve sleeve 178 includes O-rings 180 and an inner tapered seat 182 to receive a ball 184. The valve sleeve 178 is originally placed in a first position as seen in FIG. *7a* with the wall of the sleeve 178 extending over the radial ports 172. FIGS. *7b* through *7d* illustrate the valve sleeve 178 in its actuated position with the radial ports 172 uncovered. The initial position of the valve sleeve 178 is maintained until driven by the ball 184 to the lower position by shear pins. The placement of the ball 184 terminates flow from the lower end of the upper duplex assembly 20 through the body 140. With movement of the valve sleeve 178, access from the central passage in the duplex assembly 20 to outwardly of the scab casing 127 is achieved through the ports 172.

A second valve sleeve 186 is arranged above the lowermost valve sleeve 178. This second valve sleeve 186 also includes O-rings 188 to prevent flow around the sleeve 186. An inner tapered seat 190 is arranged to receive a ball 192. Each succeeding ball which is placed in the entire string must be incrementally larger in order that preceding balls can fit through the succeeding inner tapered seats. The second valve sleeve 186 also includes one or more pins 194 extending radially outwardly from the body of the sleeve 186 into and through the ports 173 formed in the body 140. The ports 173 are elongate to form slots. The valve sleeve 186 initially is positioned and held in place by shear pins with the pins 194 at the upper ends of the slots 173 as seen in FIGS. *7a* and *7b*. The sleeve 186 ends up in its lowered position with the pins 194 at the bottom ends of the slot 173 as seen in FIGS. *7c* and *7d*. In the upper position, the second valve sleeve 186 covers radial ports or slots 173 extending through the wall of the body 140. With the restraining shear pins broken by the pressure behind the ball 192, the valve sleeve 186 moves to the lower position and uncovers the ports or slots 173.

The second valve sleeve 186 is coupled via the pins 194 through the slots 173 to a sleeve assembly 195. The sleeve assembly is driven downwardly with the valve sleeve 186. The sleeve assembly 195 includes a cylindrical valve 196 which moves downwardly with the valve sleeve 186 to cover over the radial ports 174 exposed by the movement of the valve sleeve 178. The sleeve assembly 195 also closes the radial ports 172 in the body 140. This cylindrical valve 196 remains with the duplex tool when the valve assemblies are withdrawn. A lip seal 197 prevents flow upwardly around the sleeve assembly 195. With placement of the ball 192, communication with the well bore outwardly of the scab casing 127 from the central passage is terminated. At the same time, communication is established between the central passage and the annulus inwardly of the scab casing 127 through the ports or slots 173.

A locking sleeve 198 is positioned in the upper uniform bore. This sleeve also includes O-rings 200 to prevent leakage around the sleeve. An annular recess 202 is arranged about the locking sleeve 198 and an inner tapered seat 204 is arranged to receive a ball 206. With the locking seat 198 in the upper position, held by shear pins, the radial ports 158 are covered as seen in FIGS. *7a*. The floating dogs 164 are pressed outwardly so as to engage the duplex housing 116. With the introduction of the ball 206, the shear pins are broken and the locking sleeve 198 drops to the lower position exposing the radial ports 158 and relieving the floating dogs 164 from engagement with the housing 116 as seen in FIGS. *7a–7c*.

As seen in FIG. 5, an engagement pipe 208 is arranged above the adapter element 146. The engagement pipe includes a pin 210 for coupling with the internally threaded end of the adapter element 146. The engagement pipe 208 includes a mechanism as shown in FIG. 8. Further drilling pipe 10 can be tightly associated with the engagement pipe 208 which in turn can be less forcefully engaged with the valve assembly 139 of the duplex assembly 20. In this way, the pipe string engages the valve assembly and the valve assembly engages the duplex housing 116 through the lock assembly.

FIG. 4 illustrates yet another duplex assembly associated with the surface casing 25. This further assembly and any more which may be employed would be configured as the upper duplex assembly 20 and associated components. However, care must be taken that each succeeding assembly be sufficiently larger so that the components intended to be removed prior to further drilling have clearance.

Looking to the operation of the overall system, the lower duplex assembly 14 is assembled before entry into the well. This includes assembly of the lower duplex tool 27 including the duplex shoe 18 and the cylindrical housing 26. The valve assembly 42 is positioned with the body 44 extending into the cylindrical housing 26. The scab casing 16 is then assembled with the duplex tool 27. Drilling rod 10 assembled with the engagement pipe 102 is then inserted into the drill pipe 10 and threaded into the internally threaded end 48. The ratchet 106 insures locking between the engagement pipe 102 and the valve assembly 42 without requiring large torque forces on the assembly. The length of the scab casing 16 is substantially the length of the well between the lowest production zone and the adjacent production zone above it. Consequently, the height of this first assembly can be substantial and can require a significant number of drill pipe sections. The upper end of each scab liner may be castellated as shown to provide guides.

The drill pipe 10 extending above the top of the scab casing 16 is intended to traverse the second production zone from the bottom when positioned in the well.

The upper duplex assembly 20, including the cementing basket 22, the valve assembly 139 and the scab casing 127 is assembled. The scab casing 16 is fabricated to extend the length of a nonproduction zone between the second and third production zones from the bottom. This assembly is then coupled with the preceding drill pipe 10 by means of the pin 142. Additional drill pipe 10 is fed into the scab casing 127 from the other end. The engagement pipe 208 is initially coupled with the drill pipe 10 which is inserted into the scab casing 127 to couple with the adapter element 146, the ratchet assembly once again locking the string with the duplex assembly.

Successive upper duplex assemblies 20 may be assembled. Care must be taken that each succeeding system includes sizes which allow the lower systems to be removed as will be discussed below. One last upper duplex assembly 20 may be associated with the bottom of the surface casing 25 as seen in FIG. 4. Drill pipe 10 and casing 25 would then be added as the entire assembly is lowered to the appropriate position indexed with the production zones.

Once the entire assembly is in position, fluid may be introduced if desired to clean out the well. The fluid would proceed down the drill pipe 10 and through the center passage of each valve assembly, finally exiting through the lower port 34 in the duplex shoe 18. Next, a charge of cement is introduced through the drill pipe so that it also flows from the lower port 34 at the bottom of the string. As drilling fluid is present below the duplex shoe 18, the cement is caused to rise around the duplex shoe 18 and upwardly around the scab casing 16. The amount of cement is calculated to substantially fill the annular space between the scab casing 16 associated with the lower duplex assembly 14 and the well bore. As the last of the cement is fed into the well, the ball 90 is added to the circulation and the material being fed down the drill pipe is changed to drilling fluid.

As the charge of cement leaves the lower duplex assembly 14, the ball 90 seats in the valve sleeve 84. The pressure of the flow then shears the pins holding the valve sleeve 84 in the upper position and causes it to drop downwardly to the lower position. This exposes the radial ports 68 as illustrated in FIG. *6b*. The flow is then prevented from passing through the length of the duplex assembly 14 by the ball 90. Rather, flow is through the radial port 68. The radial ports 68 are shown to open above the attachment point for the scab casing 16. Consequently, flow down the drill pipe 10 exits through the radial port 68 into the annular space between the cylindrical housing 26 and the scab casing 16. In this way, the entire string is flushed of excess cement.

Once clear of cement, circulation may be discontinued. A period may be required for the cement to set around the lowermost scab casing 16 so as to support its weight.

Once a set is accomplished, circulation is again established and the ball 98 is dropped into the drill pipe 10. The ball 98 seats in the locking sleeve 92, driving the locking sleeve 92 to the lower position. This movement of the locking sleeve 92 opens the radial ports 56 so that circulation may continue. Circulation is cut off through the lower radial port 68.

Additionally, the annular recess 96 moves to a position adjacent the floating dogs 66, allowing the floating dogs 66 to release from the corresponding recesses 64 in the cylindrical housing 26. The valve assembly and the entire string attached above the valve assembly is then released. Circulation may be stopped and the valve assembly pulled upwardly to separate it from the duplex tool 27. The distance the string is lifted is only intended to be sufficient to insure that the lowermost duplex tool 27 is released.

A ball 184 is next positioned in the drill pipe and circulation resumed. The ball 184 seats in the valve sleeve 178 of the next upper duplex assembly 20. This shears the pins and causes the valve sleeve 178 to move to the lower position, opening radial ports 172. The ball 184 also terminates flow through the drill pipe 10 below this upper duplex assembly 20.

A second charge of cement is then introduced into the drill pipe. The charge is sufficient to cement the scab casing 127 into position. At the end of the charge of cement, the ball 192 is dropped into the drill pipe 10 to seat in the valve sleeve 186. As before, this valve sleeve 186 is driven downwardly to its lower position where the cylindrical valve 196 is positioned over the ports 174. At the same time, the radial ports 173 are uncovered to divert flow inwardly of the scab casing 127. Circulation continues through the radial ports 173 until the system is appropriately flushed. Once again time may then be required to allow setting of the cement to a degree sufficient to support the scab casing 127.

Ball 206 is dropped with circulation down the drill string. The ball 206 seats in the locking sleeve 198 and drives it downwardly to the lower position. This opens the radial ports 158 and releases the floating dogs 164. Again, the drill string may be lifted to insure separation.

If additional duplex systems are employed, the process is repeated through completion. Once fully completed, the assembly unlocked from the duplex tools is withdrawn from the well.

Subsequent operation typically requires a drilling out of the aluminum equipment extending inwardly of the casing bore along with residual cement. This drilling may be in concert with underreaming, the placement of liners, gravel packing and the like. Once completed, a production zone exists below what remains of the lower duplex tool 27. Another production zone is above the top of the scab casing 16 associated with that lowermost duplex tool 27 and below what remains of the upper duplex assembly 20. This pattern continues upwardly depending upon the number of scab casings placed.

Accordingly, a system for placing and cementing a plurality of casing segments in a well with one entry is disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A duplex assembly for use with drill pipe, comprising a duplex tool having a cavity;

a valve assembly including a body extendable into the cavity of the duplex tool, the body having a threaded end;

an engagement pipe including a threaded pin threadably engageable with the threaded end;

a ratchet assembly including a movably mounted ratchet and stops, one of the ratchet and the stops being on the engagement pipe and the other of the ratchet and the stops being on the valve assembly, the engagement pipe being attachable to drill pipe.

2. The duplex assembly of claim 1 further comprising a lock assembly having a locking sleeve in the body and dogs in the wall of the body outwardly of the locking sleeve and extending outwardly of the body to the duplex tool, the locking sleeve having a first position retaining the dogs locked with the duplex tool and a second position releasing the dogs.

3. The duplex assembly of claim 1 further comprising a scab casing fixed to the duplex tool, the body being seated and locked in the cavity.

4. The duplex assembly of claim 3, the stops being about the threaded end of the body, the ratchet being cylindrical with ratchet teeth at one end and movably mounted to the engagement pipe, the ratchet assembly further including a spring between the engagement pipe and the ratchet, the ratchet teeth being engaged with the stops with the threaded pin threadably engaged with the threaded end, the spring biasing the ratchet into engagement with the stops.

5. The duplex assembly of claim 1, the duplex tool including a duplex shoe.

6. The duplex assembly of claim 1, the duplex tool including a cementing basket.

7. A duplex assembly for use with drill pipe, comprising a duplex tool having a cavity extending therethrough;

a valve assembly including a cylindrical body extendable into the cavity of the duplex tool and a lock assembly on the cylindrical body selectively engageable with the duplex tool, the cylindrical body having a threaded end, the body having stops about the threaded end;

an engagement pipe including a threaded pin threadably engageable with the threaded end, a cylindrical ratchet engageable with the stops with the threaded pin threadably engaged with the threaded end, and a spring biasing the cylindrical ratchet into engagement with the stops with the threaded pin threadably engaged with the threaded end, the engagement pipe being attachable to drill pipe.

8. The duplex assembly of claim 7 further comprising a scab casing fixed to the duplex tool, the body being seated and locked in the cavity.

9. The duplex assembly of claim 7, the duplex tool including a duplex shoe.

10. The duplex assembly of claim 7, the duplex tool including a cementing basket.

11. A duplex assembly for use with drill pipe, comprising a duplex tool having a cavity extending therethrough;

a valve assembly including a cylindrical body extending into the cavity of the duplex tool, a radial port through the body, a lock assembly on the cylindrical body selectively engageable with the duplex tool and a sleeve valve in the cylindrical body having a first position blocking the radial port and a second position not blocking the radial port, the cylindrical body having a threaded end, the body having stops about the threaded end;

an engagement pipe including a threaded pin threadably engageable with the threaded end, a cylindrical ratchet engageable with the stops with the threaded pin threadably engaged with the threaded end, and a spring biasing the cylindrical ratchet into engagement with the stops with the threaded pin threadably engaged with the threaded end, the engagement pipe being attachable to drill pipe.

12. The duplex assembly of claim 11, the lock assembly having a locking sleeve in the cylindrical body and dogs in the wall of the cylindrical body outwardly of the locking sleeve and extending outwardly of the cylindrical body to the duplex tool, the locking sleeve having a first position retaining the dogs locked with the duplex tool and a second position releasing the dogs.

13. The duplex assembly of claim 11, the duplex tool including a duplex shoe.

14. The duplex assembly of claim 11, the duplex tool including a cementing basket.

15. A duplex assembly for use with drill pipe, comprising a duplex tool having a cavity;

a valve assembly including a body extendable into the cavity of the duplex tool and having a passage therethrough, a radial port from the passage through the body, a lock assembly selectively engageable with the duplex tool and a sleeve valve in the passage having a first position blocking the radial port and a second position not blocking the radial port, the lock assembly having a locking sleeve in the passage and dogs in the wall of the body outwardly of the locking sleeve and extending outwardly of the body to the duplex tool, the locking sleeve having a first position retaining the dogs locked with the duplex tool and a second position releasing the dogs.

16. A duplex assembly for use with drill pipe, comprising a duplex tool having a cavity therethrough;

a casing supported by the duplex tool;

a valve assembly including a body extendable into the cavity of the duplex tool and having a passage therethrough, a first port from the passage through the body and the duplex tool to outwardly of the casing, a second port from the passage through the body to inwardly of the casing, a first valve selectively positionable to close the passage and open the first port, a second valve selectively positionable to close the first port from the passage and open the second port.

17. The duplex shoe of claim 16, the first valve including a valve sleeve with an internal seat and a ball sized to seat on the internal seat.

18. The duplex tool of claim 16 further comprising a lock assembly having a locking sleeve in the body and dogs in the wall of the body outwardly of the locking sleeve and extending outwardly of the body to the duplex tool, the locking sleeve having a first position retaining the dogs locked with the duplex tool and a second position releasing the dogs.

19. A duplex assembly for use in a well, comprising duplex tools each having a central cavity;

scab casings fixed to the duplex tools, respectively;

valve assemblies extending into the central cavities of the duplex tools, respectively, each valve assembly including a body having a passage therethrough and a lock assembly, the lock assembly having a locking sleeve in the passage and dogs in the wall of the body outwardly of the locking sleeve and extending outwardly of the body, the locking sleeve having a first position abutting the dogs and a second position releasing the dogs, the dogs engaging the duplex tools, respectively, when the associated locking sleeve is in the first position;

pipe extending between the valve assemblies to support the valve assemblies in selected spaced relation.

20. The duplex assembly of claim 19, the valve assemblies each further including a radial port from the passage through the body and a sleeve valve in the passage having a first position blocking the radial port and a second position not blocking the radial port.

21. A duplex assembly for use in a well, comprising duplex tools each having a central cavity therethrough, the lower most duplex tool having a duplex shoe, all other duplex tools each having a cementing basket;

scab casings fixed to the duplex tools, respectively;

valve assemblies extending into the central cavities of the duplex tools, respectively, each valve assembly including a body having a passage therethrough and a lock assembly, the lock assembly having a locking sleeve in the passage and dogs in the wall of the body outwardly of the locking sleeve and extending outwardly of the body, the locking sleeve having a first position abutting the dogs and a second position releasing the dogs, the dogs engaging the duplex tools, respectively, when the associated locking sleeve is in the first position, the valve assembly associated with the duplex shoe including a first radial port from the passage through the body and a first sleeve valve in the passage having a first position blocking the first radial port and a second position not blocking the first radial port, the valve assemblies associated with the cementing baskets, respectively, each including a second radial port from the passage through the body and through the duplex tool, a cementing sleeve valve in the passage having a first position blocking the second radial port and a second position not blocking the second radial port, a third radial port through the body and a flushing sleeve valve in the passage having a first position blocking the third radial port and a second position not blocking the third radial port and blocking the second radial port;

pipe extending between the valve assemblies to support the valve assemblies in selected spaced relation.

22. The duplex assembly of claim 21, each sleeve including an annular seat with each adjacent sleeve having a progressively larger annular seat beginning with the smallest at the bottom of the well.

* * * * *